US011650545B2

(12) United States Patent
Koller

(10) Patent No.: US 11,650,545 B2
(45) Date of Patent: May 16, 2023

(54) ANALOGUE INFORMATION DISPLAY SYSTEM FOR A WATCH

(71) Applicant: Tissot SA, Le Locle (CH)

(72) Inventor: Jean-Marc Koller, Yverdon-les-Bains (CH)

(73) Assignee: Tissot SA, Le Locle (CH)

( * ) Notice: Subject to any disclaimer, the term of this patent is extended or adjusted under 35 U.S.C. 154(b) by 537 days.

(21) Appl. No.: 16/658,219

(22) Filed: Oct. 21, 2019

(65) Prior Publication Data

US 2020/0150594 A1 May 14, 2020

(30) Foreign Application Priority Data

Nov. 14, 2018 (EP) ..... 18206307

(51) Int. Cl.

| | |
|---|---|
| ***G04B 19/247*** | (2006.01) |
| ***G04B 19/06*** | (2006.01) |
| ***G04G 9/00*** | (2006.01) |
| ***G08B 5/22*** | (2006.01) |

(52) U.S. Cl.

CPC ..... *G04B 19/247* (2013.01); *G04B 19/06* (2013.01); *G04G 9/0064* (2013.01); *G08B 5/228* (2013.01)

(58) Field of Classification Search

CPC .... G04B 19/247; G04B 19/06; G04G 9/0064; G08B 5/228

USPC ..... 368/37

See application file for complete search history.

(56) References Cited

U.S. PATENT DOCUMENTS

| | | | | |
|---|---|---|---|---|
| 5,329,501 | A | 7/1994 | Meister et al. | |
| 5,465,239 | A * | 11/1995 | Koch | G04B 19/04 368/80 |
| 5,475,653 | A * | 12/1995 | Yamada | G04G 9/0064 368/80 |
| 5,479,378 | A | 12/1995 | Yamada et al. | |
| 2011/0216627 | A1* | 9/2011 | Ziemba | G04B 47/00 368/10 |
| 2016/0154382 | A1* | 6/2016 | Kakizawa | G04B 19/243 368/28 |

(Continued)

FOREIGN PATENT DOCUMENTS

| | | | |
|---|---|---|---|
| CN | 1040476 | C | 10/1998 |
| CN | 105652631 | A | 6/2016 |

(Continued)

OTHER PUBLICATIONS

Japanese Office Action dated Oct. 13, 2020 in Japanese Patent Application No. 2019-199650, (with English transiation), 9 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

An analogue information display system for a watch provided with a mechanical movement includes a display dial including a plurality of apertures, a moving display part supporting graphical representations, disposed in such a way that the graphical representations supported thereby appear in the plurality of apertures in order to generate the information, and an indicator member configured so as to designate a piece of information generated in an aperture to be notified to the wearer of the watch.

19 Claims, 1 Drawing Sheet

(56) References Cited

U.S. PATENT DOCUMENTS

| | | | | |
|---|---|---|---|---|
| 2016/0341568 | A1* | 11/2016 | Roush | A61B 5/681 |
| 2017/0084133 | A1* | 3/2017 | Cardinali | G04G 21/00 |

FOREIGN PATENT DOCUMENTS

| | | | | |
|---|---|---|---|---|
| CN | 105829976 | A | 8/2016 | |
| CN | 107526281 | A | 12/2017 | |
| EP | 2713226 | A2 * | 4/2014 | G04B 19/24 |
| JP | 2014102189 | A * | 6/2014 | |
| JP | 2014-102189 | A | 8/2014 | |
| JP | 2016-102726 | A | 6/2016 | |
| WO | WO 95/16938 | A1 | 6/1995 | |

OTHER PUBLICATIONS

Notice of Grounds for Rejection dated Jan. 19, 2021 in Korean Patent Application No. 10-2019-0139943 (with English language translation), 12 pages.

European Search Report dated May 6, 2019 in European Application 18206307.3 filed on Nov. 14, 2018 (with English Translation of Categories of Cited Documents).

Combined Chinese Office Action and Search Repbrt dated Dec. 18, 2020 in Chinese Patent Application No. 201911105013.4 (with English translation), 12 pages.

* cited by examiner

ANALOGUE INFORMATION DISPLAY SYSTEM FOR A WATCH

CROSS-REFERENCE TO RELATED APPLICATION

This application claims priority to European Patent Application No. 18206307.3 filed on Nov. 14, 2018, the entire disclosure of which is hereby incorporated herein by reference.

TECHNICAL FIELD

The present invention relates to an analogue information display system for a watch, in addition to a method for viewing at least one piece of information on a display dial of the watch.

The invention further relates to a watch comprising such a system, in addition to a computer program.

PRIOR ART

Existing analogue information display systems on mechanical watches, in particular wristwatches, all use, due to the space available on moving display parts, very few apertures, generally only one or two, in order to present information to the person wearing the watch. As a result of the limited space available on the moving parts, the information display capacity of the watch is thus significantly limited and unsuited to the diversity of the information that it should be able to display, in particular with the arrival of smartwatches.

It is understood that there is a need to find an alternative solution, in particular which overcomes the drawbacks of the prior art.

SUMMARY OF THE INVENTION

One purpose of the present invention is thus to propose an analogue information display system making it possible to display a wide range of various information, preferably different from the date, time or moon phases, in a clear manner, while being simple to implement.

Another purpose of the invention is to propose an analogue information display system that allows a passive alert/notification to be displayed, which display consumes little or no power.

For this purpose, the invention relates to an analogue information display system for a watch provided with a mechanical movement, said system including:

- a display dial comprising a plurality of apertures;
- a moving display part supporting graphical representations, disposed in such a way that the graphical representations supported thereby appear in the plurality of apertures in order to generate said information, and
- an indicator member configured so as to designate a piece of information generated in an aperture to be notified to the wearer of said watch.

In other embodiments:

- at least one aperture comprises an information-forming element arranged above the graphical representation appearing in the corresponding aperture;
- said information-forming element is a flat part comprising a network of a plurality of openings such as micro-orifices, grooves, slots or a combination of at least two of these types of openings;
- the information-forming element is a fixed part;

- the information-forming element is made in one piece with an upper or lower face of the dial in an area of this dial comprising the aperture or even with a wall of a through-opening formed by this aperture;
- the system comprises at least one element for driving the moving display part supporting graphical representations;
- the moving display part supporting information is a flat part, circular in shape, such as a disc or a ring;
- the moving display part supporting graphical representations and the display dial are coaxial, and
- the system comprises a calibration element configured so as to identify a relative position between the moving part and the dial.

The invention further relates to a watch including such a system.

Advantageously, the watch is a mechanical smartwatch.

The invention further relates to a method for viewing at least one piece of information on a display dial of the watch implemented by the system, the method including a step of presenting a piece of information in an aperture of the dial comprising a sub-step of positioning both an indicator member towards the aperture and a graphical representation or a part of a graphical representation facing a through-opening of this aperture.

The invention further relates to a computer program comprising program code instructions for executing the steps of the method according to the preceding claim when said computer program is executed by a processing unit of a watch.

BRIEF DESCRIPTION OF THE FIGURES

Other specific features and advantages will be clearly observed in the following description, which is given as a rough guide and in no way as a limited guide, with reference to the accompanying figures, in which.

DETAILED DESCRIPTION OF THE INVENTION

Figure 1:
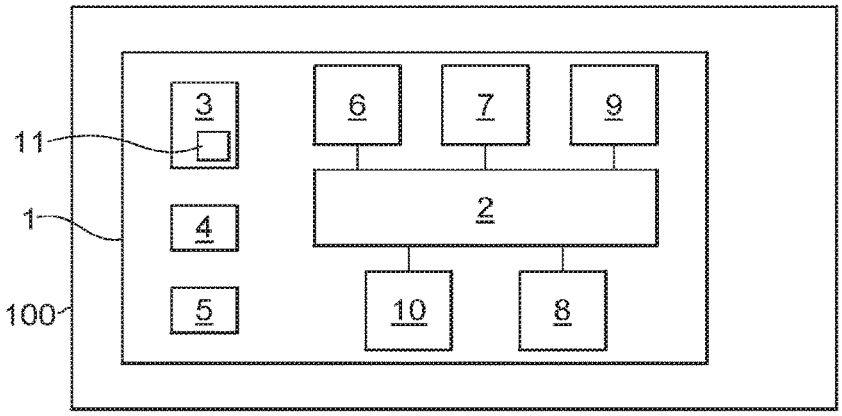
FIG. 1 is a diagrammatic view of a watch comprising an analogue information display system, according to one embodiment of the invention.

FIG. 1 shows a watch 100 comprising an analogue display system 1 for displaying at least one notification. Such a system 1 is comprised in the watch 100, which is preferably a mechanical smartwatch 100 comprising a mechanical movement. This system 1 more specifically includes, in a non-limiting and/or non-exhaustive manner:

- a processing unit 2 including hardware and software resources, in particular at least one processor cooperating with memory elements;

- a hybrid display dial 3 provided with a first analogue display component 10*a* and a second digital and/or alphanumerical display component 10*b;*
- a moving display part 4 supporting graphical representations;
- an indicator member 5 such as a hand, configured so as to designate a piece of information presented in an aperture 11 of the dial 3 to be notified to the wearer of said watch 100;
- an audio interface 7 such as a loudspeaker;
- a calibration element 9 such as a light sensor;
- an activation control 10 for activating the display of at least one notification such as a push-button, a rotating button or a tactile crystal;
- a communication module 6, and
- at least one drive element 8 for driving the moving part 4 and the indicator member 5.

The processing unit 2 of this system 1 is connected, inter alia, to the audio interface 7, to the communication module 6, to the calibration element 9, to the activation control 10 and to the drive element 8.

In this system 1, the communication module 6 is capable of establishing a connection with a cellular network system by comprising, in particular, a SIM card (acronym for "Subscriber Identity Module") or with a WLAN wireless local area network system, and is also capable of implementing communication technologies such as, for example, Bluetooth. Under these conditions, the system 1 and thus the watch 100 is capable of exchanging data with a remote server, a computer or even a smartphone.

Figure 2:
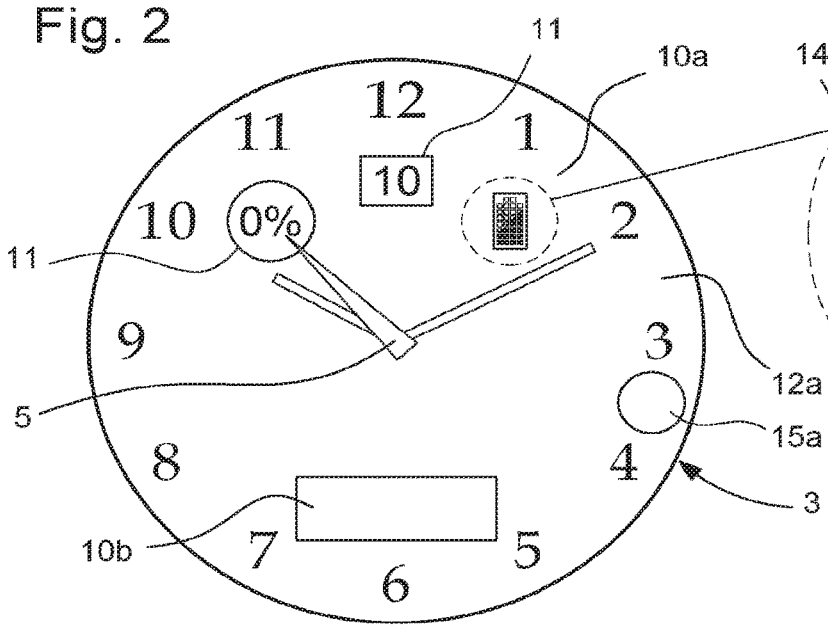
FIG. 2 is a view of the dial of the watch, according to one embodiment of the invention.
Figure 4:
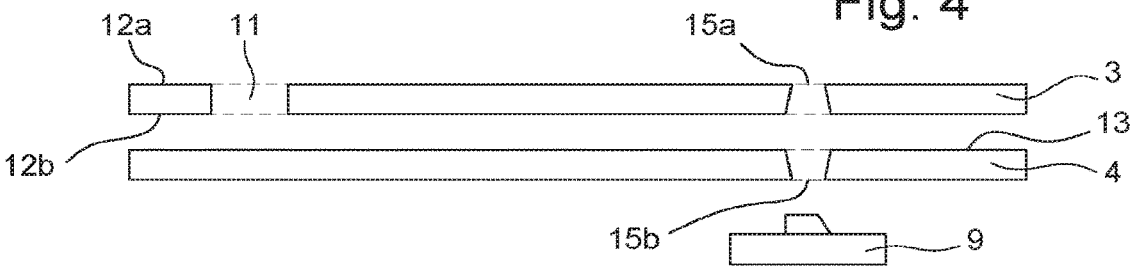
FIG. 4 is a sectional view of a set of superimposed elements comprising a display dial, a moving display part supporting graphical representations and a calibration element, according to the embodiment of the invention.

In this system 1, the display dial 3 visible in FIGS. 2 and 4 comprises an upper face 12*a* and a lower face 12*b*, the upper face 12*a* being the visible face of the dial 3 when it is arranged in the watch 100 and the lower face 12*b* being that which is arranged facing the moving part 4. The dial 3 further comprises, in the first display component 10*a*, a plurality of apertures 11 through which information is capable of being presented. Such apertures 11 each have a cross-section that can be circular or substantially quadrilateral in shape. These apertures 11 are distributed in this dial 3 so as to be able to separately cooperate with the indicator member 5 in order to indicate/notify a piece of information to the wearer of the watch 100. This information can be a notification addressed to this wearer. This notification can be an alert message regarding a function performed by the watch 100, for example a notification regarding:

- an email account, in which case the information presented in the aperture 11 can correspond to a number of messages received, for example in FIG. 2, ten messages have been received;
- an activity tracker, in which case the information can correspond to a heart rate, or a number of steps taken, etc.
- a number of missed calls when the watch 100 is connected to a smartphone;
- the UV index (acronym for ultraviolet);
- etc.

The dial 3 is mounted such that it is superimposed on the moving support part 4 which includes a face 13 comprising graphical representations. More specifically, such a moving part 4 is disposed in such a way that the graphical representations supported thereby appear in the plurality of apertures 11 of the dial 3 in order to generate information. This moving part 4, which is coaxial with the dial 3, is a circular and flat part, such as a disc or a ring.

It should be noted that each aperture 11 comprises a through-opening extending longitudinally in this aperture 11 so as to connect the upper and lower faces 12*a*, 12*b* of the dial 3 to one another.

Figure 3:
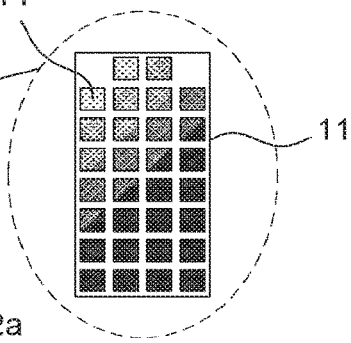
FIG. 3 is a more large-scale view of an aperture comprising an information-forming element, according to the embodiment of the invention.

In the dial 3, at least one aperture 11 comprises an information-forming element 14. This information-forming element 14 is arranged above the graphical representation appearing in the corresponding aperture 11. More specifically, such an information-forming element 14 can be made in one piece with the upper face 12*a* or the lower face 12*b* of the dial 3 in an area of this dial 3 comprising the aperture 11 or even with the wall of the through-opening formed by this aperture 11. Alternatively, this information-forming element 14 can be a fixed part that is arranged on an area of the upper face 12*a* or of the lower face 12*b* comprising the aperture 11 or even in the through-opening formed by this aperture 11. This information-forming element 14 is a flat part comprising a network/grid of a plurality of openings forming a symbol or a pattern. With reference to FIG. 3, these openings can, for example, be micro-orifices, grooves, slots or a combination of at least two of these types of opening. By way of example, when this information-forming element 14 comprises a network of micro-orifices, each micro-orifice can have:

- a square section, the length of each side whereof lies in the range 200 to 900μ, preferably 265μ, or
- a circular section, the diameter whereof lies in the range 200 to 1,000μ, preferably 374μ.

Such an information-forming element 14 allows a piece of information to be generated from a graphical representation comprised on the moving part 4. This information, as shown hereinabove, is preferably a notification. In the case of an aperture 11 provided with such an information-forming element 14, the information can relate to a rate/percentage, to a state, to an interval of values, to a parameter of a function of the watch 100 or to the functioning thereof, or even to a measurement of a bodily parameter of the wearer of the watch 100 such as a physiological parameter (pulse, impedance of the skin, blood pressure, breathing rate, respiratory arrhythmia, skin temperature, sweat rate, blood oxygen level or blood flow).

For the purposes of illustration, this information-forming element 14 can comprise a plurality of openings visible in FIG. 3, jointly forming a pattern such as a battery. This plurality of openings can cooperate with a graphical representation such as a colour gradation for generating a piece of information relative to the state of power charge of the watch 100. More specifically, as this state of charge reduces, the battery-shaped pattern changes colour according to the colour gradation relative to the graphical representation. This change in colour occurs from small rotations of the moving part 4.

It is understood here that in order to generate such a piece of information regarding the power charge of the watch 100 in an aperture 11 devoid of such an information-forming element 14, the moving part 4 must comprise a plurality of graphical representations of a battery, each illustrating a different state of charge. In this context, such a configuration of the aperture without any information-forming element 14 thus consumes/requires a large amount of space on the face 13 of the moving part 4 and more significant rotations of the moving part, which thus limits the variety of information that can be presented in the apertures 11.

In another example, the information-forming element 14 can comprise a plurality of openings jointly forming a pattern such as a heart. This plurality of openings can cooperate with a graphical representation such as a colour gradation for generating a piece of information relative to a heart rate interval. More specifically, as a function of the interval in which lies the measurement of the heart rate of the wearer, the colour varies according to the colour gradation relative to the graphical representation. This change in colour occurs from small rotations of the moving part 4.

It should be noted that the graphical representations intended to be presented in an aperture 11 devoid of any information-forming element 14 are defined in a portion of the face 13 of the moving part 4; said portion having a surface area that is smaller than that of a cross-section of this aperture 11. Conversely, the graphical representations intended to be presented in an aperture 11 comprising an information-forming element 14 are defined in a portion of the face 13 of the moving part 4 which has a surface area that is larger than that of a cross-section of this aperture 11.

In this system 1, the moving part 4 and the indicator member 5 are set in motion under the action of at least one drive element 8 such as a motor. The drive element 8 is controlled by the processing unit 2 as a function of the information to be presented in one or more apertures 11 of the dial 3.

Since this processing unit 2 is connected to at least one drive element 8 and to a calibration element 9, it is also capable of positioning the disc relative to the dial 3 in order to ensure correct display of the graphical representations in the apertures 11. With reference to FIG. 4, in this system 1, when the calibration element 9 is a light sensor, the moving part 4 and the dial 3 both comprise openings 15*a*, 15*b* which can be aligned with the calibration element 9 such that said element receives visible radiation. In particular, the opening 15*b* extends into an area of the moving part 4 arranged facing the calibration element 9 when this part 4 is rotating. This opening 15*b* is defined throughout this area with the exception of reduced portions of different lengths of this area intended to conceal the calibration element 9. These portions enable, in particular as a result of the differences therebetween, a known position of the moving part 4 relative to the dial 3 to be detected.

Moreover, with reference to FIG. 4, the dial 3, the moving part 4 and the calibration element 9 are mounted such that they are superimposed inside the watch case 100. It should be noted that the calibration element 9, when this is a light sensor, can enable a UV index to be measured, which can be a piece of information presented in an aperture 11 of the dial 3, when the calibration element 9 and the openings 15*a*, 15*b* are aligned.

Figure 5:
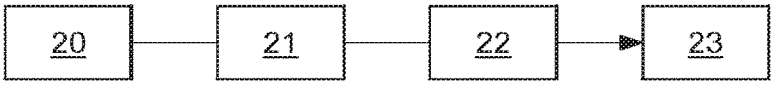
FIG. 5 shows a flow chart relating to a method of viewing at least one piece of information on a display dial, according to the embodiment of the invention.

Such a system 1 of the watch 100 is capable of implementing a method for viewing at least one piece of information on the display dial 3 of the watch 100 visible in FIG. 5.

This method comprises a step of actuating 20 the activation control 10. This control is defined so as to contribute to the presentation of one or more pieces of information. During this step 20, the actuation of the control results in a generation of a signal, which is transmitted to the processing unit 2.

The method then provides for a step 21 of presenting a piece of information in the aperture 11 of the dial 3. This step 21 comprises a sub-step 22 of positioning both an indicator member 5 towards the aperture 11 and a graphical representation or a part of a graphical representation facing the through-opening of this aperture 11. For this purpose, as soon as the processing unit 2 receives the signal originating from the activation control 10, it generates a control instruction intended to position the indicator member 5 on/in/towards the aperture 11 that is to present the information by controlling the drive element 8. Simultaneously or quasi-simultaneously, it also positions the corresponding graphical representation or the part of the graphical representation facing the through-opening of the aperture 11 by also controlling the drive element 8 to cause the moving part 4 to rotate. This control instruction is generated by the processing unit 2 on the basis of:

- identifying the information, the display whereof is desired from the processing of the signal originating from the activation control 10, for example this information can be the state of charge of the watch 100;
- carrying out a measurement (for example to measure the state of charge of the watch 100) or recovering data originating from a remote server, a computer or a smartphone (for example recovering, from the smartphone, a number of missed calls) relative to the information identified,
- selecting the adapted aperture 11 for presenting the information as a function of the information identified,
- defining control instructions to be applied to the drive element 8 in order to control the displacement of the indicator member 5 and of the moving part 4.

Moreover, this method comprises a step 23 of calibrating the position of the moving part 4 relative to the dial 3. Such a step 23 enables an optimum positioning of the graphical representations or of parts of these graphical representations to be obtained in the apertures 11 during the implementation of this method. During this step 23, the openings 15*a*, 15*b* of the dial 3 and of the moving part 4 are aligned with the calibration element 9, in this case a light sensor. In this configuration, this light sensor receives visible radiation and generates a signal which is then transmitted to the processing unit 2. Upon receiving this signal, the processing unit 2 can thus identify the position of the moving part 4 relative to the dial 3 and update, where appropriate, configuration data archived in the memory elements thereof comprising this relative position between the moving part 4 and the dial 3 for the functioning of the method and of the display system 1. It is thus understood that the alignment of these openings 15*a*, 15*b* with the light sensor 9 constitutes a point of reference or an index allowing the relative position between the moving part 4 and the dial 3 to be identified.

The invention further relates to a computer program comprising program code instructions for executing steps 20 to 23 of this method when said computer program is executed by a processing unit of the watch 100.

The invention claimed is:

1. An analogue information display system for a watch provided with a mechanical movement, said system comprising:

- a display dial comprising a plurality of apertures;
- a moving display part supporting graphical representations, disposed in such a way that the graphical representations supported thereby appear in the plurality of apertures in order to generate information; and
- an indicator member configured so as to designate a piece of the information generated in an aperture of the plurality of apertures to be notified to a wearer of said watch, wherein
- at least one aperture of the plurality of apertures comprises an information-forming element arranged above the graphical representation appearing in a corresponding aperture, and
- said information-forming element is configured to display one of operational functions of the watch as a color gradation between two colors having a plurality of transitional colors and a body parameter of the wearer as a color gradation between two colors having a plurality of transitional colors.

2. The system according to claim 1, wherein said information-forming element is a flat part comprising a network of a plurality of openings including micro-orifices, grooves, slots or a combination of at least two categories of the micro-orifices, grooves, or slots.

3. The system according to claim 1, wherein the information-forming element is a fixed part.

4. The system according to claim 1, wherein the information-forming element is made in one piece with an upper face or lower face of the display dial in an area of the display dial comprising the aperture or even with a wall of a through-opening formed by the aperture.

5. The system according to claim 1, further comprising at least one drive element for driving the moving display part supporting graphical representations.

6. The system according to claim 1, wherein the moving display part supporting graphical representations is a flat part, circular in shape, such as a disc or a ring.

7. The system according to claim 1, wherein the moving display part supporting graphical representations and the display dial are coaxial.

8. The system according to claim 1, further comprising a calibration element configured so as to identify a relative position between the moving display part and the display dial.

9. A watch comprising:

the system according to claim 1.

10. The watch according to claim 9, wherein the watch is a mechanical smartwatch.

11. A method for viewing at least one piece of information on a display dial of a watch implemented by an analogue information display system that includes a display dial comprising a plurality of apertures, a moving display part supporting graphical representations, disposed in such a way that the graphical representations supported thereby appear in the plurality of apertures in order to generate information, and an indicator member configured so as to designate a piece of the information generated in an aperture of the plurality of apertures to be notified to a wearer of said watch, wherein at least one aperture of the plurality of apertures comprises an information-forming element arranged above the graphical representation appearing in a corresponding aperture, and said information-forming element is configured to display one of operational functions of the watch as a color gradation between two colors having a plurality of transitional colors and a body parameter of the wearer as a color gradation between two colors having a plurality of transitional colors, the method comprising:

presenting a piece of information in the at least one aperture of the plurality of apertures of the display dial, the presenting comprising positioning both an indicator member towards the at least one aperture of the plurality of apertures and a graphical representation or a part of a graphical representation facing a through-opening of the at least one aperture of the plurality of apertures.

12. A non-transitory computer readable medium comprising program code instructions for executing a method for viewing at least one piece of information on a display dial of a watch implemented by an analogue information display system that includes a display dial comprising a plurality of apertures, a moving display part supporting graphical representations, disposed in such a way that the graphical representations supported thereby appear in the plurality of apertures in order to generate information, and an indicator member configured so as to designate a piece of the information generated in an aperture of the plurality of apertures to be notified to a wearer of said watch, wherein at least one aperture of the plurality of apertures comprises an information-forming element arranged above the graphical representation appearing in a corresponding aperture, and said information-forming element is configured to display one of operational functions of the watch as a color gradation between two colors having a plurality of transitional colors and a body parameter of the wearer as a color gradation between two colors having a plurality of transitional colors, the method comprising:

presenting a piece of information in the at least one aperture of the plurality of apertures of the display dial, the presenting comprising positioning both an indicator member towards the at least one aperture of the plurality of apertures and a graphical representation or a part of a graphical representation facing a through-opening of the at least one aperture of the plurality of apertures, wherein said computer program is executed by a processor of the watch.

13. The system according to claim 1, wherein the body parameter corresponds to a physiological parameter of the wearer.

14. The system according to claim 1, wherein said information-forming element is a flat part comprising a network of a plurality of openings including micro-orifices.

15. The system according to claim 1, wherein said information-forming element is a flat part comprising a network of a plurality of openings including grooves.

16. The system according to claim 1, wherein said information-forming element is a flat part comprising a network of a plurality of openings including slots.

17. The system according to claim 1, wherein said information-forming element is a flat part comprising a network of a plurality of openings including a combination of at least two categories of micro-orifices, grooves, or slots.

18. The system according to claim 1, wherein the body parameter includes a physiological parameter including at least one of a pulse, an impedance of a skin, a blood pressure, a breathing rate, a respiratory arrhythmia, a skin temperature, a sweat rate, a blood oxygen level, and a blood flow.

19. The system according to claim 1, wherein the gradient is a color gradient, and colors of the color gradient are configured to vary based on information relative to the operational functions of the watch and the body parameter.

* * * * *